US010380847B2

(12) United States Patent
Carson

(10) Patent No.: US 10,380,847 B2
(45) Date of Patent: Aug. 13, 2019

(54) DIGITAL LOTTERY GAME CONTROL SYSTEM

(75) Inventor: John T. Carson, Pennington, NJ (US)

(73) Assignee: GREEN LOTTERY TECHNOLOGIES, Greenville, NC (US)

( * ) Notice: Subject to any disclaimer, the term of this patent is extended or adjusted under 35 U.S.C. 154(b) by 1008 days.

(21) Appl. No.: 11/827,554

(22) Filed: Jul. 11, 2007

(65) Prior Publication Data

US 2009/0017893 A1 Jan. 15, 2009

(51) Int. Cl.
*G07F 17/32* (2006.01)

(52) U.S. Cl.
CPC ..... *G07F 17/329* (2013.01); *G07F 17/32* (2013.01)

(58) Field of Classification Search
USPC ..... 463/17, 25, 42; 380/247, 256, 270; 379/903, 93.02; 273/138.2, 139; 455/410; 705/14
See application file for complete search history.

(56) References Cited

U.S. PATENT DOCUMENTS 4,922,522 A * 5/1990 Scanlon ..... 463/17
5,327,485 A * 7/1994 Leaden ..... 463/17
5,791,990 A * 8/1998 Schroeder et al. ..... 463/17
6,024,641 A * 2/2000 Sarno ..... 463/17
6,134,309 A 10/2000 Carson
6,203,011 B1 3/2001 Nulph
6,368,218 B2 4/2002 Angell, Jr.
6,533,274 B1 3/2003 Heggerty
6,707,915 B1 * 3/2004 Jobst et al. ..... 380/247
6,824,464 B2 11/2004 Weil et al.
7,128,319 B2 10/2006 Finocchio
7,153,206 B2 12/2006 Bennett, III
7,163,459 B2 1/2007 Tanskanen
7,316,614 B2 * 1/2008 Dietz et al. ..... 463/25
2002/0090930 A1 * 7/2002 Fujiwara et al. ..... 455/410
2003/0092478 A1 5/2003 Weil
2003/0092479 A1 * 5/2003 Weil et al. ..... 463/17
2004/0054623 A1 * 3/2004 Collins et al. ..... 705/39
2004/0097283 A1 * 5/2004 Piper et al. ..... 463/17
2004/0116176 A1 * 6/2004 Tulley et al. ..... 463/17
2005/0075160 A1 4/2005 Weil et al.
(Continued)

FOREIGN PATENT DOCUMENTS

WO WO 2005081148 A1 * 9/2005 ..... G06Q 30/00

*Primary Examiner* — Robert T Clarke, Jr.
(74) *Attorney, Agent, or Firm* — Porzio Bromberg & Newman

(57) ABSTRACT

The present invention relates to a system and method for purchase, activation and use of a pre-paid lottery voucher for purchase and play of electronic lottery tickets on an electronic device. The pre-paid lottery vouchers act as a recording device for all transactions associated with the lottery voucher. Each electronic ticket purchased with the pre-paid lottery voucher is recorded against a unique voucher identification at a remote digital lottery game control system. Players can play through the number of electronic tickets that the pre-paid voucher entitles them to and then redeem the pre-paid voucher for any winnings that the lottery voucher is entitled to. Winnings can only be redeemed for payout at an authorized lottery redemption agent and cannot be used for purchase of additional electronic lottery tickets, thereby providing a play responsibly feature.

10 Claims, 4 Drawing Sheets

(56) References Cited

U.S. PATENT DOCUMENTS

| | | | | |
|---|---|---|---|---|
| 2005/0096135 | A1* | 5/2005 | Houchin | 463/42 |
| 2007/0060284 | A1* | 3/2007 | Yacenda | 463/17 |
| 2007/0162330 | A1* | 7/2007 | Olmstead et al. | 705/14 |
| 2008/0076528 | A1* | 3/2008 | Nguyen | G07F 17/32 463/25 |
| 2008/0310633 | A1* | 12/2008 | Brown et al. | 380/259 |
| 2009/0124273 | A1* | 5/2009 | Back | 455/466 |

* cited by examiner

DIGITAL LOTTERY GAME CONTROL SYSTEM

BACKGROUND OF THE INVENTION

1. Field of the Invention

This invention relates to a lottery gaming system which provides control of digital purchase and play of lottery games on mobile phone and interactive television devices including a play responsibly feature.

2. Description of Related Art

Pre-paid cards have been used to link to a lottery game such as a state run Pick 4, Pick 6 or the like. U.S. Pat. No. 6,134,309, issued to one of the inventors of the present disclosure, describes a pre-paid phone card system in which a user purchases a pre-paid phone card for a fixed fee which entitles the user to a set amount of long distance service and a promotional lottery ticket. The existing lottery system is used to activate the phone card and produce the promotional ticket.

U.S. Published Patent Application No. 2005/0075160 describes a pre-paid account lottery system. A plurality of lottery cards are distributed to at least one lottery agent. Each of the lottery cards has a unique identification code disposed thereon and is associated with a predefined monetary amount. A communication identifying the unique identification code of a first selected card is received, and a user account associated with the identification code is established having a balance equivalent to the predefined monetary amount of the first selected card. A first chosen play for a lottery game is received and associated with the user account. A cost of the first chosen play is deducted from the balance of the user account, and a remaining balance is available for making at least one subsequent play. If the first chosen play is a winner, a winning monetary amount is credited to the user account. The winning monetary amount may be redeemed upon presentation of the first selected card. The system allows the user to make lottery plays using funds credited to the user's account.

Real-time lotto-type games in an interactive wireless environment have been described. U.S. Pat. No. 7,163,459 describes a wireless station to play a real-time lottery game electronically. A betting service provider maintains security and a win/loss determination on a system apart from the wireless station. A debit for each game ticket selected is taken from an account at the betting service provider. If the user wins, a certain amount of money is credited to the betting service account. The credit can be made in the form of the issue of new lottery game tickets with or without additional credit to the users account. This system cannot be used with present lottery systems which control the purchase of lottery tickets at a lottery agent.

Conventional main lottery central systems take orders for numbers games, validate winning tickets and allow lottery tickets to be printed at lottery agents. It is not desirable for the main lottery system to receive communications other than ticket purchases and validations because of the chance that the system could be slowed down during peak lottery demand times or security could be affected. Main Central Lottery Systems do not allow direct player access.

It is desirable to provide a digital lottery game control system, separate from the main lottery central system, for controlling the purchase, activation and use of pre-paid lottery voucher for digital purchase and play of a predetermined number of electronic lottery tickets on a mobile phone or interactive television device thereby allowing direct player access; recording transactions associated with the pre-paid lottery voucher; and posting any winnings that the electronic ticket may be entitled to on the pre-paid lottery voucher for redemption by an authorized lottery redemption agent.

SUMMARY OF THE INVENTION

The present invention relates to a system and method for purchase, activation and use of a pre-paid lottery voucher for purchase and play of electronic lottery tickets on an electronic device. In one embodiment, players can use the purchased pre-paid lottery voucher to purchase electronic lottery tickets through their cellular/mobile phone or an interactive television system.

The pre-paid lottery vouchers act as a recording device for all transactions associated with the lottery voucher. The voucher information is pre-generated and the lottery voucher is subsequently sold. The lottery voucher can be produced at a terminal at a lottery agent. Alternatively, the lottery voucher can be pre-printed and forwarded to a lottery agent for sale. Each electronic ticket purchased with the pre-paid lottery voucher is recorded against a unique voucher identification at a separate digital lottery game control system. Upon sale of the lottery voucher or activation of the lottery voucher by a player, a record in the digital lottery game control system is updated.

The lottery voucher is issued in a predetermined amount for purchase of a predetermined number of electronic lottery tickets. The lottery voucher can be generated for a specific electronic lottery product, such as an electronic instant ticket, an electronic draw ticket, an electronic instant draw ticket and the like. Each electronic ticket purchased with the pre-paid lottery voucher and any winnings are recorded against the unique voucher identification. Players can access the history of the lottery voucher to determine how many plays have been used, how many plays are remaining, the games played, and the total value of prizes won. The digital lottery game control system will record all voucher transactions real time. Voucher records recorded on the digital lottery game control system can be accessed as needed by the main central lottery system, or the digital lottery game control system can securely update the main central lottery so both systems will be synchronized.

Players can play through the number of electronic tickets that the pre-paid voucher entitles them to and then redeem the pre-paid voucher for any winnings that the lottery voucher is entitled to, or the player can discontinue play and redeem the pre-paid lottery voucher for the value of any remaining plays and the value of any previous winnings. Winnings can only be redeemed for payout at an authorized lottery redemption agent and cannot be used for purchase of additional electronic lottery tickets, thereby providing a play responsibly feature.

In one embodiment, the voucher identification is communicated by calling a telephone number of the digital lottery game control system displayed on the lottery voucher and entering the voucher identification. In one embodiment, a purchase request for play of an electronic lottery game is forwarded from an electronic device of a cellular phone and is received at the digital lottery game control system. The purchase request includes the voucher identification. Before or after sending the purchase request, a player accesses the digital lottery game control system for downloading information, such as the software needed, for playing of the electronic lottery game on the cellular phone. Downloaded information can be stored in memory of the cellular phone to allow the electronic lottery game to be accessed without additional downloads. The purchase request is verified at the digital lottery game control system using the record associated with the voucher identification received with the purchase request. The digital lottery game control system determines if the purchase request is from a valid lottery voucher having an established record; if there are sufficient plays left on the lottery voucher to purchase an electronic ticket to allow play of the electronic lottery game; and if there are electronic tickets remaining in the electronic lottery game. If all three conditions are met, an electronic lottery ticket is forwarded to the cellular phone to allow play of the electronic lottery game at the cellular phone. The consumer plays the electronic ticket in conformance with the rules established for the electronic lottery game. The record is updated to indicate a purchase of an electronic lottery ticket and to deduct the played electronic ticket from the predetermined amount of electronic lottery tickets associated with the lottery voucher. Any prize won from the played electronic ticket is recorded in the record.

During redemption of the lottery voucher, the authorized lottery redemption agent accesses the main central lottery system and enters voucher identification for determining the value of the lottery voucher. Thereafter, the lottery redemption agent can payout the value of the lottery voucher. All voucher information for all issued lottery vouchers is maintained on the digital lottery game control system which information is continually updated in real time and is forwarded to the main central lottery system either instantly or upon request.

The invention will be more fully described by reference to the following drawings.

DETAILED DESCRIPTION

Figure 1:
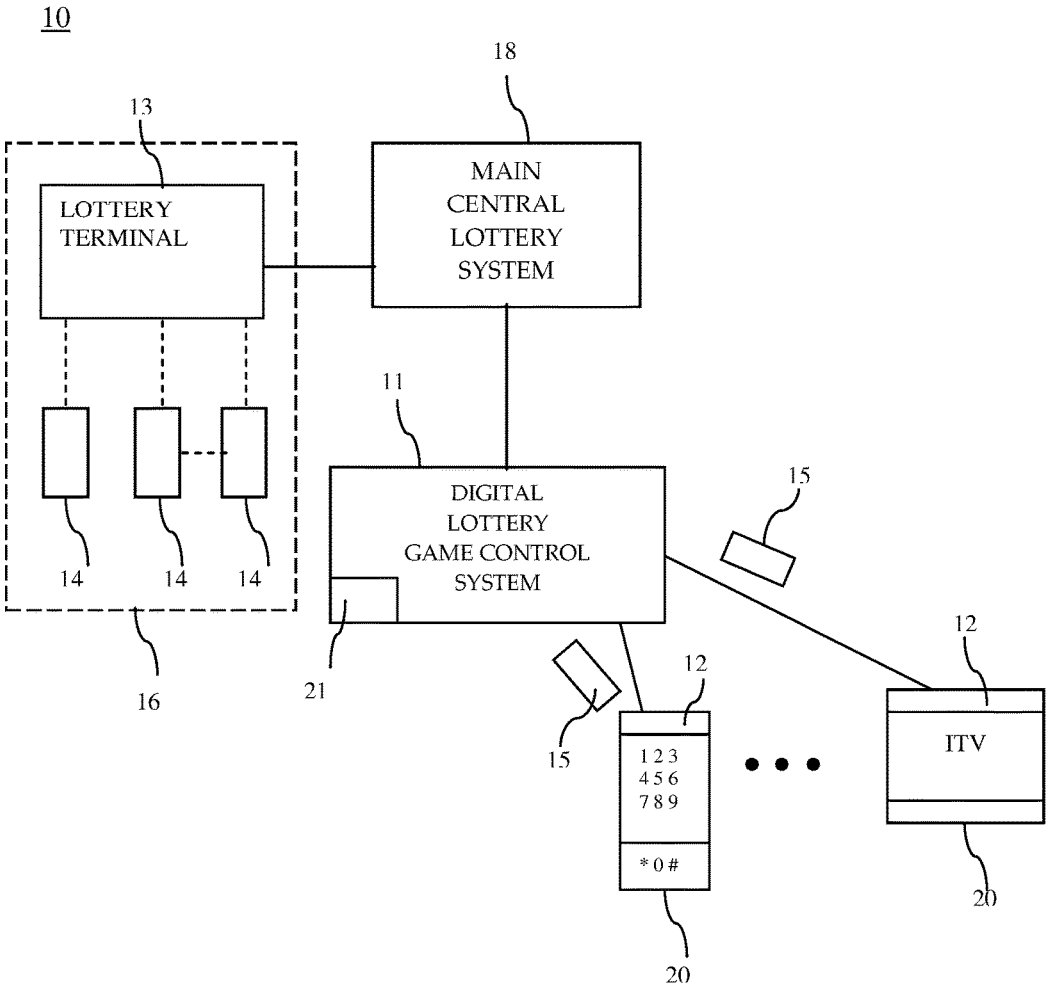
FIG. 1 is a schematic diagram of a lottery gaming system in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic diagram of lottery gaming system 10 in accordance with the teachings of the present invention. Lottery gaming system 10 comprises digital lottery game control system 11 and one or more electronic lottery games 12. Digital lottery game control system 11 can communicate with main central lottery system 18. Alternatively, for lotteries without a main central lottery system, the digital lottery game control system 11 can be used as the main central lottery system.

Digital lottery game control system generates information for lottery voucher 14. For example, lottery information can include voucher identification 15. In one embodiment, lottery terminal device 13 produces lottery voucher 14 including voucher identification 15. Lottery terminal device 13 can be located at lottery retail outlet 16. Thereafter, a lottery sales agent at lottery retail outlet 16 sells lottery voucher 14. Alternatively, lottery voucher 14 can be preprinted at printer 103 to produce lottery voucher 14 on behalf of main central lottery system 18. Thereafter, lottery voucher 14 is forwarded from main central lottery system 18 to lottery retail outlet 16 for sale of lottery voucher 14 by a lottery sales agent.

In the embodiment of FIG. 1, upon a request made at lottery terminal device 13, main central lottery system 18 communicates with digital lottery game control system 11 to obtain lottery identification 15 of voucher 14 for sale. Main central lottery system 18 obtains a voucher value of voucher 14 from digital lottery game control system 11. Digital lottery game control system 11 sends voucher identification 15 and the voucher value to main central lottery system 18. Digital lottery game control system 11 updates record 21 to indicate lottery voucher 14 having lottery identification 15 was distributed. Digital lottery game control system 11 charges main central lottery system 18 for the cost of voucher 14. Main central lottery system 18 records the cost of voucher 14 against the retailer's account. Main central lottery system 18 sends voucher identification 15 to lottery terminal device 13 at the retailer for sale and forwards information to digital lottery game control system 11 to record the sale in record 21. If lottery terminal device 13 cancels the sale request voucher identification 15 is sent back to main central lottery system 18 which deposits it back to digital lottery game control system 11.

Figure 2:
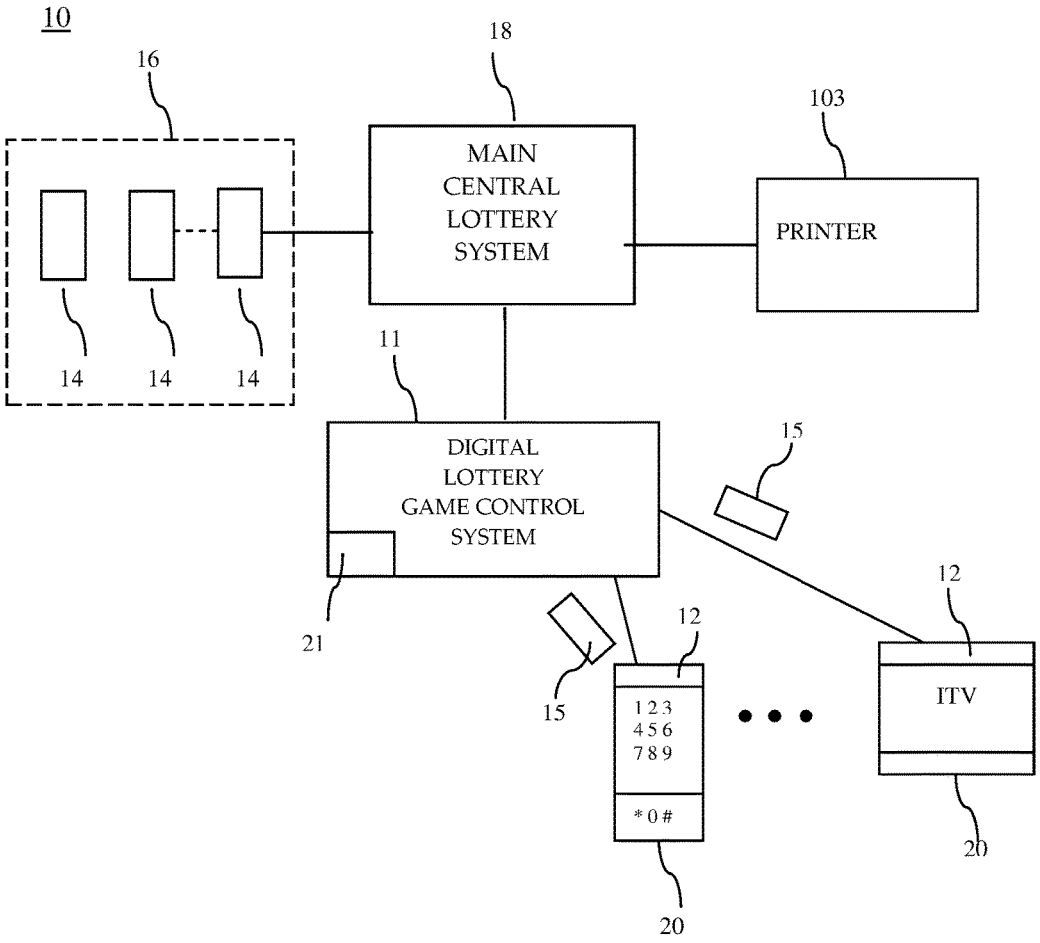
FIG. 2 is a schematic diagram of an alternate embodiment of a lottery gaming system in accordance with the teachings of the present invention.

Alternatively, referring to FIG. 2, in an alternate embodiment, digital lottery game control system 11 supplies a block of voucher identifications 15 to main central lottery system 18 for sale and records voucher identifications 15 as distributed in record 21. Main central lottery system 18 records the sales of vouchers 14 against a retailers account. Main central lottery system 18 sends voucher identifications 15 to the retailer for sale and forwards information to digital lottery game control system of the voucher identifications 15 sent to the retailer.

Main central lottery system 18 provides a record of sold vouchers 14 having voucher identifications 15 to digital lottery game control system 11 at predetermined intervals, such as hourly, to update voucher record to sold status, for settlement purposes. Main central lottery system 18 calls digital lottery game control system 11 to determine voucher value (if required), redeems voucher 14, records the redemption value against the retailer's account and forwards the redemption information to digital lottery game control system 11 for updating record 21. Accordingly, main central lottery system 18 is used for selling and redeeming vouchers 14 and all other activity is processed by digital lottery game control system 11. In one embodiment a lot of lottery vouchers 14 in the form of a package can be forwarded from main central lottery system 18 to lottery retail outlet 16. Accordingly, lottery voucher 14 can be produced on behalf of main central lottery system 18 or on behalf of individual lottery sales agents having lottery terminal device 13. In the case wherein lottery voucher 14 is produced on behalf of main central lottery system 18, all sales from lottery voucher 14 will be accredited to the lottery directly. In the case where lottery voucher 14 is produced on behalf of individual lottery sales agents, all sales from lottery voucher 14 are accredited to the lottery sales agent from whom lottery voucher 14 was purchased. In either case the lottery sales agent from lottery voucher 14 can be paid a sales commission for the sale of lottery voucher 14. Since the sale of lottery voucher 14 is equal to the price of tickets sold individually the sales commission can equal the sales commission for other lottery products.

Lottery voucher 14 can include built-in security features at the lottery's option. In one embodiment, entering voucher identification 15 can record a signature of electronic device 20. For example, the signature can be a seed in RMS memory on electronic device 20, such as a cell phone, uniquely identifying the phone number of the cell phone. The one-to-one association between voucher identification 15 and electronic device 20, such as a cellular phone, allows the lottery to track where all electronic tickets are delivered to, and provide the player with history information after redemption. During verification, the signature is forwarded with voucher identification 15 to digital lottery game control system 11 and at digital lottery game control system 11 voucher identification 15 is verified by the signature. The one-to-one association between voucher identification 15 and electronic device 20, such as a cellular phone, allows voucher play to be restricted to a single electronic device 20. Lottery voucher 14 can have an expiration date, requiring all use and redemption to occur within a predetermined date, such as six months of purchase, or any legally required time frame set by the lottery.

Figure 3:
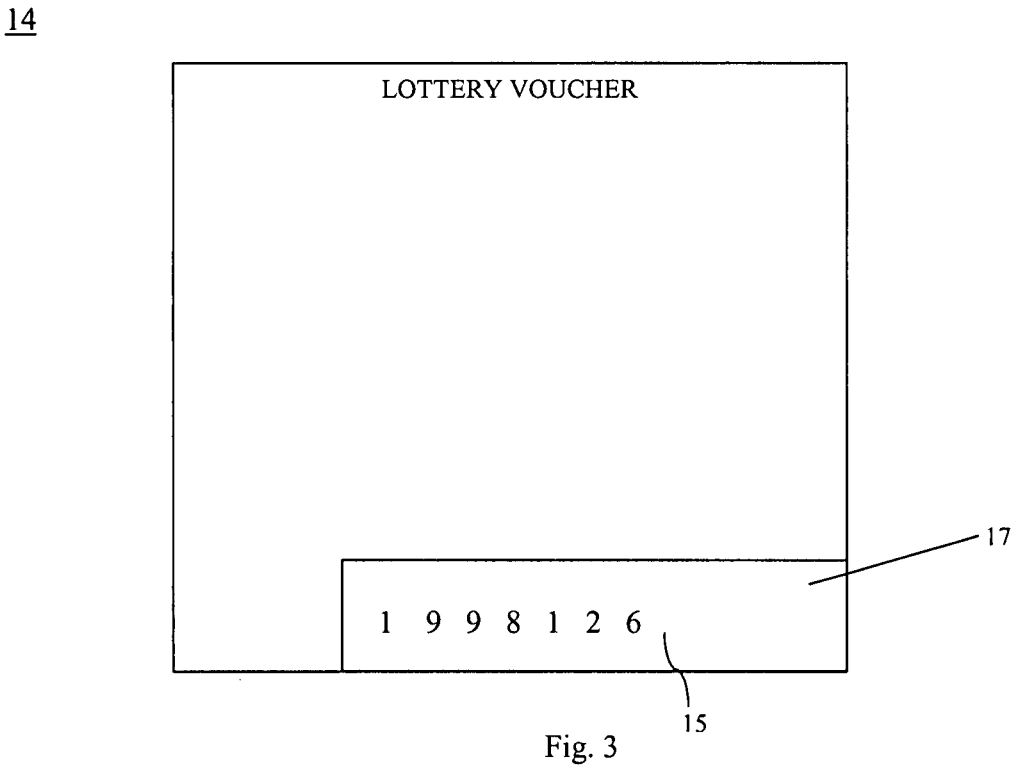
FIG. 3 is a schematic diagram of a lottery voucher card.

An example lottery voucher 14 is shown in FIG. 3. In this embodiment, lottery voucher 14 is pre-printed with voucher identification 15 hidden under removable covering 17. For example, lottery voucher 14 can be a card formed from paper stock, paper bond, plastic or the like and removable covering 17 can be formed of an opaque covering. Removable covering 17 can be removed to reveal voucher identification 15.

Figure 4:
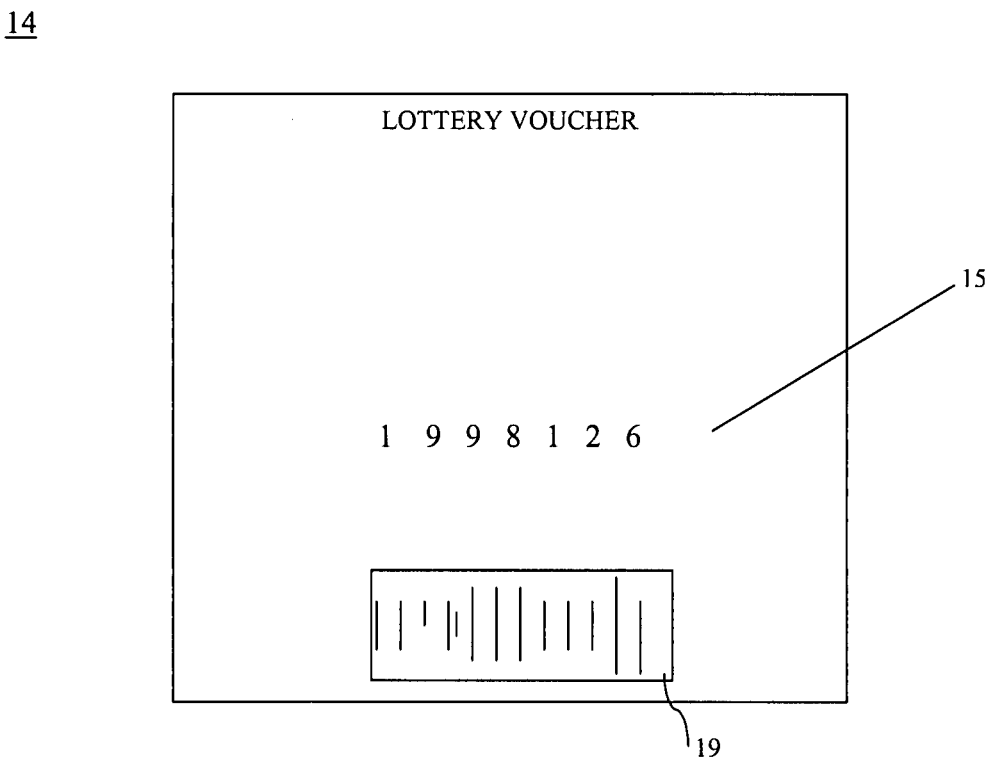
FIG. 4 is a schematic diagram of an alternative lottery voucher card.

An alternative example voucher card is shown in FIG. 4. Lottery voucher 14 is generated through a lottery terminal device of lottery terminal device 13. Indicia of voucher identification 15 can be printed on lottery voucher 14 by lottery terminal device 13. Machine readable indicia 19 can be printed on lottery voucher 14. Machine readable indicia 19 can be in the form of a bar code for facilitating sale and redemption of lottery voucher 14.

Lottery voucher 14 is issued in a predetermined amount for purchase of a predetermined number of electronic lottery tickets. Lottery voucher 14 is lottery specific and sold only in increments of the specific lottery. For example, a ten-dollar lottery voucher card can be used to purchase ten one-dollar lottery tickets or five two-dollar lottery plays or any other combination of values adding up to ten-dollar lottery voucher cards. Lottery voucher 14 can be generated for a specific game or group of games. Lottery voucher 14 can be generated for a specific electronic lottery product, such as an electronic instant ticket, an electronic draw ticket, an electronic instant draw ticket and the like. Prizes are only returned to lottery voucher 14 and cannot be used for purchases of additional lottery tickets and must be redeemed for value, as described below.

Referring to FIGS. 1 and 2, digital lottery game control system 11 controls the purchase, activation and use of lottery voucher 14 and play of electronic lottery games 12. Digital lottery game control system 11 communicates with lottery terminal device 13 for producing lottery voucher 14 including voucher identification 15. Typically, upon sale of lottery voucher 14 at a lottery sales agent, voucher identification 15 is forwarded from the lottery sales agent using lottery terminal device 13 to digital lottery game control system 11. For example, lottery voucher 14 including a bar code containing voucher identification 15 can be swiped at lottery retail outlet 16 to forward voucher identification 15 to digital lottery game control system 11. Alternatively, a package of a plurality of lottery vouchers 14 received at lottery retail outlet 16 can include a bar code containing one or more voucher identifications 15. The bar code containing one or more voucher identifications 15 can be swiped at lottery retail outlet 16 to forward the one or more voucher identifications 15 to digital lottery game control system 11. Alternatively, lottery voucher 14 can be activated by a player using electronic device 20 forwarding the voucher identification 15 to digital lottery game control system 11.

Digital lottery game control system 11 establishes record 21 associated with voucher identification 15. Record 21 can include fields associated with the predetermined amount for purchase of electronic lottery tickets, plays remaining on the lottery voucher to purchase electronic tickets and amount of any prize won. Digital lottery game control system 11 receives communications from electronic device 20 including voucher identification 15 in order to access and update record 21. In one embodiment, digital lottery game control system 11 is updated to update one or more record 21 each time a lot of lottery vouchers 14 are distributed to lottery retail outlet 16. Alternatively, digital lottery game control system 11 is updated each time lottery retail outlet 16 sells lottery voucher 14. Alternatively, digital lottery game control system 11 is updated each time lottery voucher 14 is activated at electronic device 20. Digital lottery game control system 11 records in record 21 all purchase and/or redemption requests associated with lottery voucher 14. Digital lottery game control system 11 provides information to main central lottery system 18 periodically or upon request to provide for full lottery prize validation. Digital lottery game control system 11 stores electronic lottery games 12 and can download electronic lottery games 12 to electronic device 20 as described below.

Electronic lottery games 12 can comprise instant-lottery format games in which an electronic ticket with a predetermined result is forwarded to a player for play. Electronic lottery games 12 can comprise electronic draw-lottery format games, where the player enters an electronic game with other players, and a result is determined at a future time from a draw. Electronic lottery games 12 can comprise instant-draw format lottery games, in which each purchase causes a draw to occur instantly to determine the results. Electronic lottery games 12 can comprise staged play, in which game continuation, or prize values, is based on previous events within the game.

Suitable electronic devices 20 include a wireless station, such as a cellular phone or an interactive television system. Electronic devices 20 provide firmware, hardware, and display capabilities to enable playing of a selected electronic lottery game 12. Electronic device 20 can access record 21 associated with voucher identification 15 for accessing a history of lottery voucher 14, such as how many plays have been used, how many plays are remaining, the type of games played the total value of prizes won to date and the total current value of lottery voucher 14.

Figure 5:
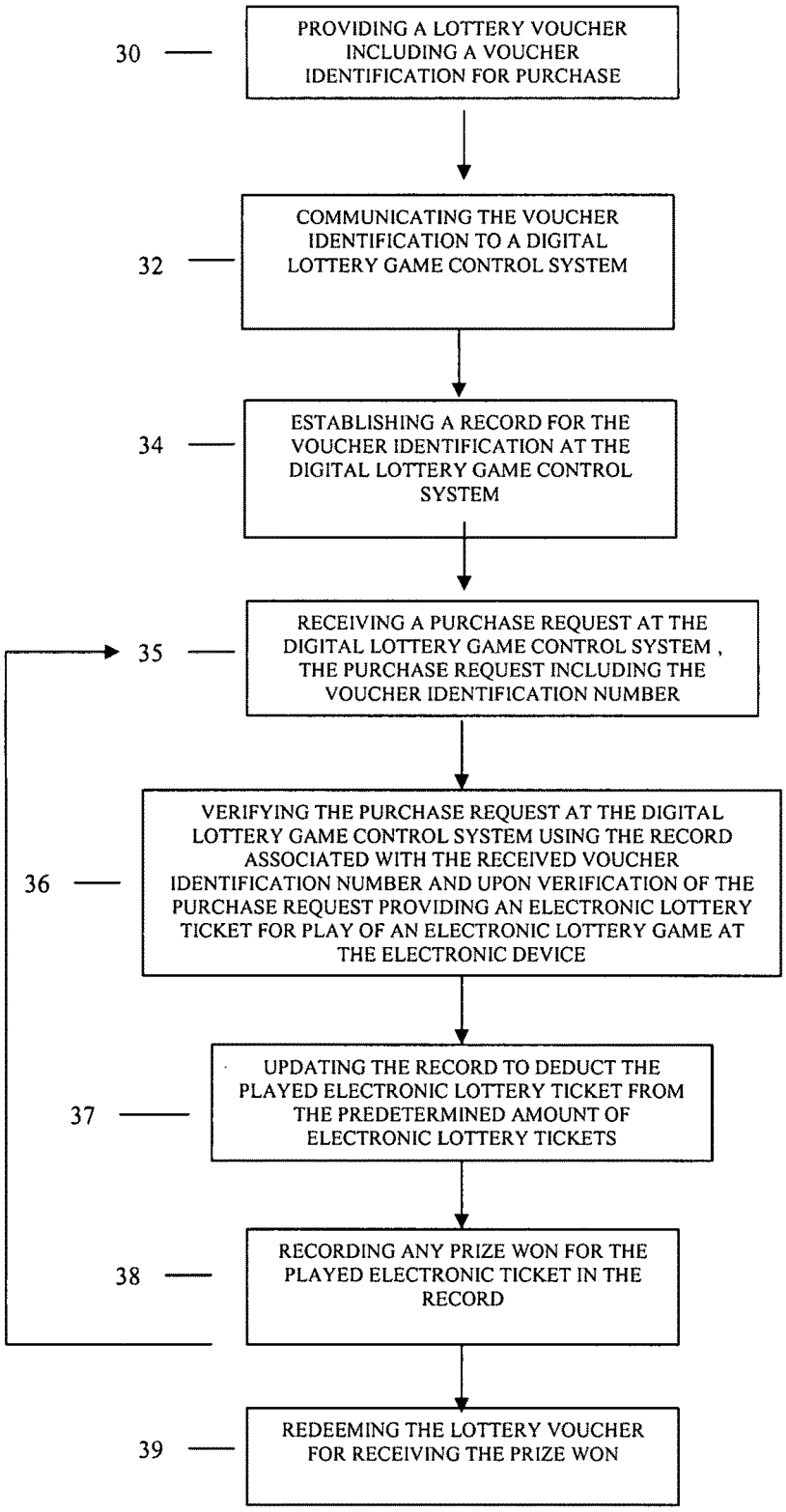
FIG. 5 is a flow diagram of a method for controlling purchase and play of electronic lottery tickets on an electronic device.

FIG. 5 is a flow diagram of a method for controlling purchase and play of electronic lottery tickets on an electronic device. In block 30, lottery voucher 14 is provided for purchase. Lottery voucher 14 includes voucher identification 15. In block 32, voucher identification 15 is communicated to digital lottery game control system 11. In one embodiment, voucher identification 15 is communicated by calling a telephone number displayed on lottery voucher 14 and entering voucher identification 15. The telephone number is associated with digital lottery game control system 11. In one embodiment, voucher identification 15 is forwarded to digital lottery game control system 11 by entering voucher identification 15 with a key pad of the cellular phone. In one embodiment, voucher identification 15 is stored in memory of electronic device 20 to allow voucher identification 15 to be accessed without re-entering voucher identification 15. In one embodiment, a prompt menu is displayed on electronic device 20 with an entry which can be activated for entering of voucher identification 15.

In block 34, record 21 is established for voucher identification 15 at digital lottery game control system 11. Fields of record 21 for the predetermined amount for purchase of electronic lottery tickets and plays remaining on the lottery voucher to purchase electronic tickets are updated. In block 35, a purchase request for play of an electronic lottery game is forwarded from electronic device 20 and is received at digital lottery game control system 11. The purchase request includes voucher identification 15. Before or after sending the purchase request, a player accesses digital lottery game control system 11 for downloading information, such as software, for playing of electronic lottery game 12 on electronic device 20. In one embodiment, lottery voucher 14 has imprinted thereon indicia of directions for accessing and downloading an electronic lottery game 12. Downloaded information can be stored in memory of electronic device 20 to allow electronic lottery game 12 to be accessed without additional downloads. In one embodiment, a prompt message is displayed on electronic device 20 with entries for electronic lottery game downloads and help services.

In block 36, the purchase request is verified at digital lottery game control system 11 using record 21 associated with voucher identification 15 received with the purchase request. Digital lottery game control system 11 determines if the purchase request is from a valid lottery voucher 14 having an established record 21; if there are sufficient plays left on lottery voucher 14 to purchase an electronic ticket to allow play of electronic lottery game 12; and if there are electronic tickets remaining at a lottery for electronic lottery game 12. If all three conditions are met, an electronic lottery ticket is forwarded to electronic device 20 to allow play of electronic lottery game 12 at electronic device 20. The consumer plays the electronic ticket in conformance with the rules established for electronic lottery game 12.

If the electronic ticket is from an electronic instant draw, a draw is instantly conducted and the results of the draw are forwarded to the player. If voucher identification 15 is verified for the requested purchase and electronic lottery game 12 is an electronic draw ticket, optionally a confirmation request can be electronically sent to the player to confirm the selection and draw date. The player can confirm that the numbers desired and draw date match the confirmation. If the player confirms the information, the player's number request is recorded in an electronic ticket and the electronic ticket is forwarded to electronic device 20. An SMS message sent from digital lottery game control system 11 to electronic device 20 can be sent to provide confirmation of the ticket purchase. If voucher identification 15 is verified for the requested purchase and electronic lottery game 12 is an instant draw ticket, optionally a confirmation request can be sent to the player to confirm the selection. The player can confirm that the numbers desired match the confirmation. If the player confirms the information, the player's number request is recorded in an electronic ticket.

In block 37, record 21 is updated to indicate a purchase of an electronic lottery ticket and to deduct the played electronic ticket from the predetermined amount of electronic lottery tickets associated with lottery voucher 14. If the purchase was for an electronic instant ticket, record 21 associated with voucher identification 15 is updated to reflect the ticket purchase and deduct the played electronic lottery ticket from the predetermined amount of electronic lottery tickets. If the purchase was for an electronic draw ticket, record 21 associated with voucher identification 15 is updated to record the unique ticket number along with the selected numbers and draw date. If the purchase was for an instant draw ticket, the unique ticket number assigned, along with the selected numbers and date of purchase is recorded in record 21 associated with voucher identification 15. Post draw any prize won will be recorded to update the record 21.

In block 38, any prize won from the played electronic ticket is recorded in record 21 associated with voucher identification 15. Example electronic lottery games include an electronic instant ticket, electronic draw ticket or an electronic instant draw ticket. Posting the winnings to the player's account at the time the electronic instant game ticket is returned to the player for play, or posting the winnings to the player's account for an electronic draw ticket or electronic instant draw ticket upon completion of the draw provides assurance that the player will receive any winnings to which they are entitled despite any possible interruption in transmission. After a draw an SMS message can be sent to electronic device 20 to provide draw results.

Steps 35 through 38 can be repeated up to the predetermined amount of electronic tickets of lottery voucher 14. Block 39 can be performed for redeeming lottery voucher 14 to an authorized lottery redemption agent for receiving the price recorded in record 21 associated with voucher identification 15. Lottery voucher 14 is presented to an authorized lottery redemption agent. During redemption of lottery voucher 14, the authorized lottery redemption agent accesses main central lottery system 18 and enters voucher identification 15, and determines the value of lottery voucher 14. All of this information is maintained on digital lottery game control system 11 which continually updates main central lottery system 18 or updates main central lottery system 18 upon request Upon learning the value of lottery voucher 14 the lottery agent will select the cashing option. Applying the cashing option will direct the lottery agent to pay the consumer the value of lottery voucher 14 and post a paid notification to lottery voucher 14 rendering it valueless for the future. Accessing main central lottery system 18 to determine value prior to payment assures the consumer that the agent has sufficient funds on hand for payment.

Lottery voucher 14 can be redeemed at any time from the authorized lottery redemption agent. In the case where lottery voucher 14 has a value due solely to prizes won, lottery voucher 14 can be redeemed for the total of all prizes won. Redeeming lottery voucher 14 renders lottery voucher 14 valueless. In the case where the value of lottery voucher 14 is due solely to unused ticket purchases, lottery voucher 14 can be redeemed for the total value of all unused ticket purchases. Redeeming lottery voucher 14 renders lottery voucher 14 valueless. In the case where the value of lottery voucher 14 is due in part to prizes won and in part to unused ticket purchases, lottery voucher 14 can be redeemed for the total value of lottery voucher 14 combining both portions. Redeeming lottery voucher 14 renders lottery voucher 14 valueless. Validation can also be accomplished with a call in validation process using an interactive recognition (IVR) or a call center. Lottery vouchers 14 are bearer instruments. Like lottery tickets, lottery vouchers 14 can be redeemed by the holder of lottery voucher 14.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A method of controlling purchase, play and redemption of electronic lottery game tickets on an electronic device comprising the steps of:

providing a digital lottery game control system, said digital lottery game control system establishing an electronic pre-paid lottery voucher record containing a pre-determined number of plays associated with a pre-paid lottery voucher;

providing the pre-paid lottery voucher for purchase, said pre-paid lottery voucher having a unique voucher identification;

associating a signature of said electronic device with said unique voucher identification;

communicating only said unique voucher identification and said signature to the digital lottery game control system with the electronic device, said digital lottery game control system providing access to the electronic pre-paid lottery voucher record containing the pre-determined number of plays associated with the unique voucher identification;

verifying said unique voucher identification at said digital lottery game control system by said signature;

said electronic pre-paid lottery voucher record being updated to show each purchase request processed;

controlling access to said digital lottery game control system and access to one or more electronic lottery games stored at said digital lottery game control system based on the remaining plays of the electronic pre-paid lottery voucher record, controlling display on said electronic device of said one or more electronic lottery games by said digital lottery game control system;

updating said electronic pre-paid lottery voucher record to record each purchase request and associated game pre-determined results by said digital lottery game control system;

forwarding the updated electronic pre-paid voucher record and associated game pre-determined results to a central lottery system to be synchronized with the digital lottery game control system for allowing the central lottery system to determine pre-determined lottery prize validations;

recording in said electronic pre-paid lottery voucher record said pre-determined lottery prize validations; redeeming lottery prize payments based on said pre-determined lottery prize validations; and posting a paid notification to said electronic pre-paid lottery voucher record.

2. The method of claim 1 wherein the pre-paid lottery voucher is manufactured in advance, distributed and sold by retailers, said electronic pre-paid lottery voucher record existing for the pre-paid lottery voucher.

3. The method of claim 1 wherein the pre-paid lottery voucher is a bearer instrument.

4. The method of claim 1 wherein the unique voucher identification is displayed in human readable or human readable and machine readable form.

5. The method of claim 1 wherein the unique voucher identification is covered or partially covered with an opaque removable covering.

6. The method of claim 1 wherein the electronic device communicates with the digital lottery game control system using a web-accessible device.

7. The method of claim 1 wherein the pre-determined number of plays controls access to the one or more electronic lottery games on an occurrence basis.

8. The method of claim 1 wherein the one or more electronic lottery games is an instant win style game and further comprising the steps of:

verifying that sufficient play remains in the electronic pre-paid lottery voucher record;

and updating the electronic pre-paid lottery voucher record to show receipt, play, play results, and prizes won wherein the electronic device is web-accessible.

9. The method of claim 1 further comprising the step of using the unique voucher identification for accessing a voucher transaction history, said voucher transaction history showing purchase, play and prize history information.

10. The method of claim 1 wherein the electronic device is a mobile phone and said signature is a unique identity of the mobile phone.

* * * * *